US006303187B1

(12) United States Patent
Leino et al.

(10) Patent No.: US 6,303,187 B1
(45) **Date of Patent: *Oct. 16, 2001**

(54) METHOD AND AN APPARATUS FOR COATING PAPERBOARD WITH A COATING MIX HAVING A HIGH SOLIDS CONTENT

(75) Inventors: Mika Leino; Stefan Kuni, both of Järvenpää (FI); Jukka Linnonmaa, Wisconsin, WI (US); Jaana Ahlroos, Falun (SE); Erja Nikula, Vantaa (FI)

(73) Assignee: Valmet Corporation, Helsinki (FI)

( * ) Notice: Subject to any disclaimer, the term of this patent is extended or adjusted under 35 U.S.C. 154(b) by 0 days.

This patent is subject to a terminal disclaimer.

(21) Appl. No.: 09/423,262

(22) PCT Filed: May 7, 1998

(86) PCT No.: PCT/US98/09322

§ 371 Date: Nov. 23, 1999

§ 102(e) Date: Nov. 23, 1999

(87) PCT Pub. No.: WO98/50170

PCT Pub. Date: Nov. 12, 1998

Related U.S. Application Data

(60) Provisional application No. 60/046,156, filed on May 9, 1997.

(51) Int. Cl.[7] ..... B05D 3/12

(52) U.S. Cl. ..... 427/356; 118/126; 118/410; 118/413

(58) Field of Search ..... 427/356; 118/126, 118/410, 413

(56) References Cited

U.S. PATENT DOCUMENTS

| | | | |
|---|---|---|---|
| 5,104,697 | 4/1992 | Heikkinen et al. | 427/356 |
| 5,112,653 | 5/1992 | Damrau et al. | 427/356 |
| 5,674,551 | 10/1997 | Koskinen et al. . | |
| 5,741,550 | 4/1998 | Paloviita et al. . | |

FOREIGN PATENT DOCUMENTS 2272850A 1/1994 (GB) .

*Primary Examiner*—Katherine A. Bareford
(74) *Attorney, Agent, or Firm*—Cohen, Pontani, Lieberman & Pavane

(57) ABSTRACT

A method and apparatus for producing paperboard, the method comprising the steps of applying a coating mix layer having a thickness greater than that of the final coat thickness to the surface of the web being coated using a coating mix formulation in which the solids content is at least 55%, passing the web with the coat applied thereto to a doctor blade located downstream in the travel direction of the web at a distance from the applicator apparatus such that the dwell time from the application step of the coating mix to the doctoring step is at least 130 ms, and smoothing the coat layer to its final thickness by means of a doctor blade. By this method a smooth surface can be obtained even on high coat weights.

12 Claims, 11 Drawing Sheets

1
2
3
4
5
6
7
8
9
10
11
12
13
14
15

| | SET LAYER | ROUGHENING | SMOOTHNESS | EVENNESS |
|---|---|---|---|---|
| ABSORPTION CAPABILITY OF THE BASE WEB-INCREASES | INCREASES | INCREASES | DECREASES | INCREASES |
| COMPRESSIBILITY OF THE BASE WEB-INCREASES | ——— | ——— | INCREASES | INCREASES |
| WATER RETENTION CAPABILITY OF THE COATING MIX-DECREASES | INCREASES | INCREASES | DECREASES | INCREASES |
| ROUGHNESS OF THE BASE WEB-INCREASES | ——— | ——— | DECREASES | DECREASES |

FIG. 6

FIG. 11

| | | | | | | | GLOSS | PRINT GLOSS | | | | |
|---|---|---|---|---|---|---|---|---|---|---|---|---|
| | | | | | | | LEHMANN 75 | | | MOTTLE | ROUGHNESS | |
| | COAT WEIGHT | | VK456 | GRAMMAGE | THICKNESS | DENSITY | | 4x100% | 100% | U-4-6 | PPS-s1.0 | BENDTSEN |
| STATION | (g/m2) | TOTAL | VARIATION | (g/m2) | (um) | (kg/m3) | (%) | BLACK | BLACK | 40%BLACK | (um) | (ml/min) |
| | | | | | | | | | | | | |
| | | | | | | | | | | | | |
| AB+AB+AB | 9+5.5+8.5 | 23 | 5.68 | 297.5 | 546 | 545 | 57.9 | 81.7 | 73.3 | 2.44 | 0.83 | 69.6 |
| AB+OCD+AB | 9+7+5.5 | 21.5 | 4.25 | 300 | 522 | 574 | 58.9 | 83.6 | 73 | 2.31 | 0.82 | 49.2 |
| AB+AB | 10.5+10 | 20.5 | 5.43 | 295.8 | 524 | 565 | 48.7 | 76.2 | 61.7 | 2.51 | 1.03 | 55 |
| AB+OCD | 8+15 | 23 | 3.22 | 299.9 | 527 | 569 | 47.7 | 71.9 | 61.6 | 1.96 | 1.42 | 61 |

METHOD AND AN APPARATUS FOR COATING PAPERBOARD WITH A COATING MIX HAVING A HIGH SOLIDS CONTENT

This is a national stage application of PCT/US98/09322, filed May 7, 1998, which application claimed the benefit of priority of U.S. Provisional Application No. 60/046,156, filed May 9, 1997.

FIELD OF THE INVENTION

The present invention is related to a method for coating paperboard with a coating mix which has a high solids content during the application step and an apparatus for implementation of the method.

BACKGROUND OF THE INVENTION

Conventionally, paperboard is coated using a spreading roll or film transfer roll coater combined with air knife doctoring. The base board often has a rough surface as well as inferior and uneven brightness owing to the lesser bleaching of paperboard base stock as compared to bleaching of printing paper. Also brown paperboard is frequently used as the base sheet. The coat layer applied by means of an air knife coater accurately conforms to the surface profile of the base sheet and is of homogeneous thickness, which assures a high opacifying power of the coat layer. Due to such a constant-thickness coat layer, dark-colored or uneven surface of the paperboard base sheet will become efficiently coated, but the surface of the applied coat will not reach the smoothness of a sheet coated with a blade or rod coater. Further, the use of an air knife coater sets a severe limitation to the maximum web speed owing to the weak doctoring effect of the air knife. The solids content of the coating mix must be kept low to prevent premature drying of the coating mix before it reaches the air knife. After the coat is applied to the web, the moisture of the coating mix begins to absorb into the base sheet, whereby the solids content at the web surface begins to increase. Resultingly, the applied coat undergoes formation of two sublayers: a dry lower layer of high solids content on the base sheet surface and, overlying this layer, an upper layer having a solids content approximately equal to that of the virgin coating mix applied on the sheet. The lower sublayer facing the base sheet is called a set coat layer. In practice, the air doctor is only capable of stripping off excess coat down to the interface between the upper and the set sublayers, whereby the final coat thickness can be controlled in air knife coating by adjusting the dwell time between the coat metering step and the doctoring step.

If the coat is doctored by means of an air knife, the maximum solids content of the coating mix to be applied may not exceed 45–53%, because at higher solids content levels the air knife will become inefficient in removing the excess coat from the sheet surface. As the formation of a set coat layer requires a sufficiently long dwell time between the coat metering and doctoring steps, air knife coaters must have the coat applicator and the air knife arranged to operate against separate backing rolls. Another reason for the need of separate backing rolls arises from the fact that the applicator roll and the coat mist collecting chamber of the air knife cannot be accommodated physically about a single backing roll. Typically, the distance between the applicator roll and the air knife is in the order of 1–3 m, whereby the dwell or setting time will be 120–3600 ms for web speeds in the range 50–500 m/min. The longer the dwell time is made, the lower the solids content of the applied coating mix must be in order to achieve a prescribed even coating thickness.

Besides in air knife applicators, paperboard is coated in blade coater stations having the applicator roll adapted to operate against the same backing roll with the doctor blade. A coat smoothed by means of a doctor blade has an even surface, but the thickness of the applied coat layer will be determined by the surface roughness variations of the paperboard base sheet. If the base stock is excessively rough, the risk arises that the doctor blade begins to run supported by the peaks of the roughness profile, whereby such peaks will remain lacking a sufficient amount of coat. As a further result of such a coat of uneven coat layer thickness, the opacifying power of the coat will vary over the sheet thus causing mottled strike-through of the base sheet color. In practice, this problem will be evident for insufficiently bleached paperboard base stock grades only.

The maximum web speed of blade coaters is typically higher than that of air knife coaters, and the speed is chiefly limited by the maximum controllable running speed of the applicator roll. The running speed of the applicator roll is maximally 1500 m/min, and for paperboards, the practical running speed is in the range 300–800 m/min which in a typical coater with a single backing roll designed for a dwell length of 300–600 mm gives a dwell time in the range 22.5–120 ms. As compared to air knife coating, blade doctoring allows a higher solids content of the coating mix, whereby 55–70% solids may typically be used. When an applicator roll is used for spreading the coating layer, the coating mix is pressed into the paper board in the nip of the applicator roll and a backing roll, whereby water is filtered into the base board web and the board roughens due to swelling of the fibers of the board. Also the pigment particles of the coating mix may be pressed deep in the pores of the base web. Because of the preroughening of the base web and the pressing of the pigment particles into the web, the coating mix can not be made to settle evenly on the base web, but the coating layer evens out the unevenness of the surface of the base web while the thickess of the coating layer is uneven. Usually it has been considered that increased dwell times do not give any quality edge in the blade coating.

SUMMARY OF THE INVENTION

It is an object of the present invention to provide a method and apparatus capable of improving the quality of coated paperboard in an essential manner with respect to known techniques.

The object of the invention is achieved by means of coating the paperboard base web with coating mix of at least 55% solids, levelling the applied coat by a doctor blade and arranging the dwell time between the coat metering step and the doctoring step to be at least 130 ms when the web speed is in the range 300–800 m/min.

When nozzle- or blade application of the coating mix is used for spreading the coating mix, the mix is not pressed into the base web as hard as in roll application. Because of the lower application pressure impulse, the filtration rate of the coating mix is lower and the water of the mix does not preroughen the base web as in roll application. The pigment particles are not pressed as deep into the base web as in roll application. When the nozzle or blade application is used, especially in combination with a high solids content of the coating mix and long dwell time, the coating mix with its pigment particles remains on the unroughened base web. In other words, the application of the coating mix does not essentially increase the initial roughness of the base web which leads to a smoother final product.

Since the structure of the base web is porous, the water of the coating mix is sucked into the web because of capillary forces. When the water is removed from the coating mix, a settled layer begins to form on the border layer between the paper board and the coating mix. The thickness of the settled layer increases as the dwell time increases. If the dwell time is short, no settled layer is formed. If the settled layer that comes to a doctoring blade is sufficiently thick, the pressure impulse directed into the coating layer is not sufficiently strong to break the settled layer and to press the coating mix into the pores of the base web and the coating stays clearly on the base web. Depending on the compressibility of the base paper board web, different type of coating results are achieved. If the base web is compressible coating layer having an even thickness is achieved. If base web does not compress, the surface of the coating layer is smoother.

The formation of the settled layer is enhanced by a good water abroption capability of the base web and a low water retention capability of the base web. Of course, too good water absoption and low water retention may lead to pre- or post-roughening of the web. Also high roughness of the base web makes it difficult to notice the benefits of the invention, since very rough base board is difficult to coat evenly.

Blade doctoring can operate at essentially higher web speeds than air knife doctoring, and because of the lower risk of web breaks in paperboard coating as compared to paper coating, the higher web speed of blade doctoring can improve profitability in a substantial manner. The web speed may be further increased by using a jet-nozzle applicator as the coater, whereby the maximum web speed will not be limited by the speed constraint of the applicator roll. However, the maximum web speed in this arrangement is limited by the drying capacity of the coater station, because the drying of coated paperboard requires a substantially high amount of energy, and at higher web speeds, the number of needed dryer units increases, which leads to a longer and more costly coater station construction. Hence, as it is now possible to increase the web speed with a simultaneous improvement of coat quality, the benefits of the present invention will be extremely significant.

The apparatus according to the invention makes it easy to replace the spreading roll and the applicator and doctoring units of air knife coaters in existing systems during a rebuild and thus improves the quality of coated grades.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the following, the invention will be examined in greater detail by making reference to the appended drawings, in which

FIG. 6 is a table of the effects of certain properties of the base web and the coating mix on the coating process and the end result.

FIG. 11 is a table showing results of a trail run.

DETAILED DESCRIPTION OF THE PRESENTLY PREFERRED EMBODIMENTS

Figure 5:
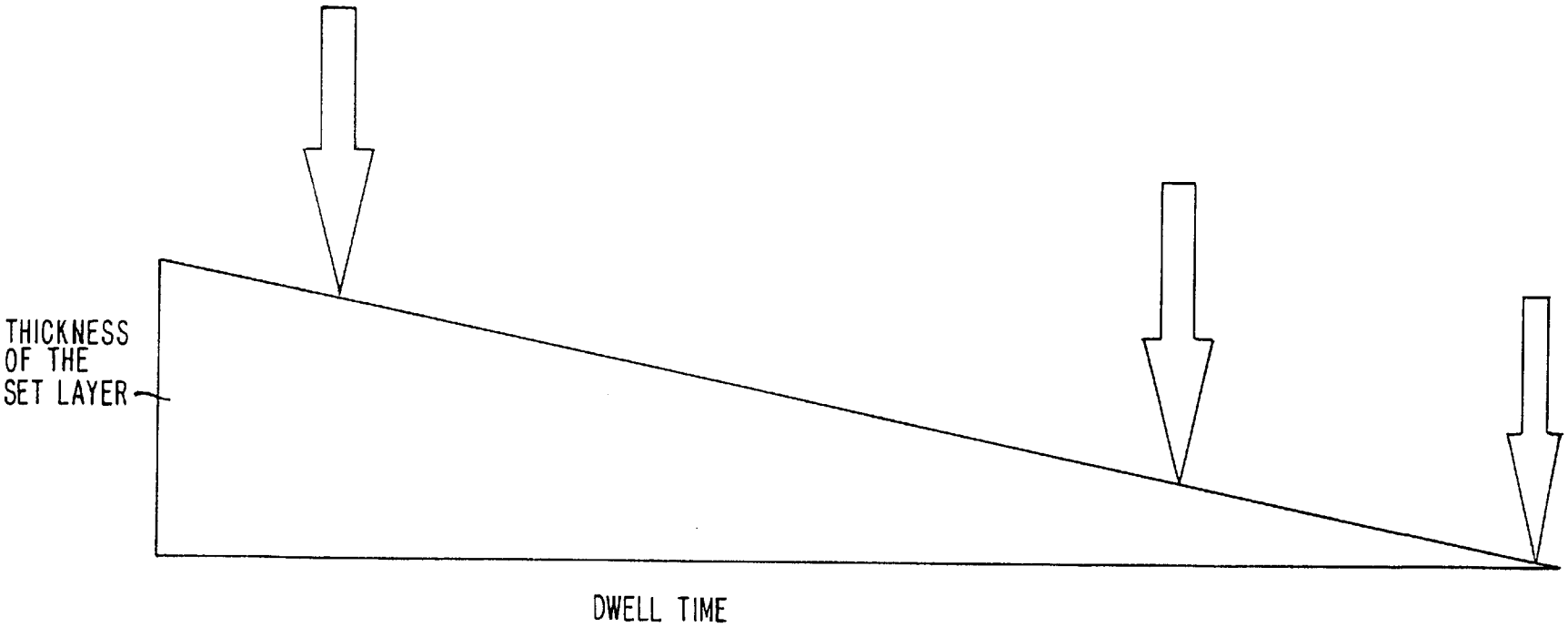
FIG. 5 is a graph describing the effects of the lenght of the application pulse to the thickness of the coaating layer.

The FIG. 5 is a simple graph showing that when the length of the application impulse increases, the thickness of the settled layer decreases. In practice this means that thinnest settled layer is achieved when a roll applicator is used and when nozzle or blade or pemetered blade applicators are used, the thickness of the settled layer is greater. Normally the shortest application pressure impulse is achieved with a nozzle applicator.

Figure 1:
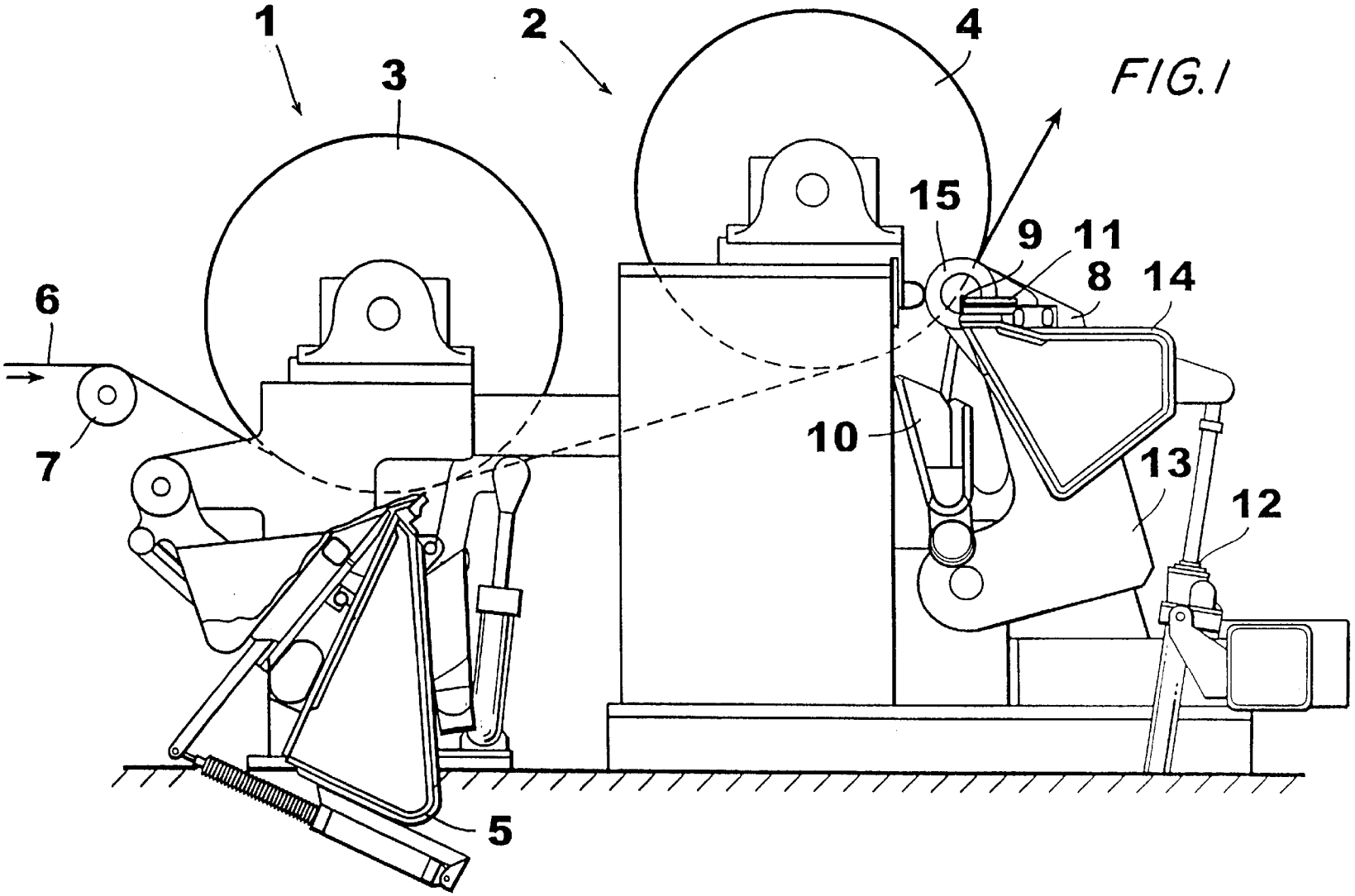
FIG. 1 shows an apparatus suitable for implementing the method according to the invention.

Referring to FIG. 1, the coater shown therein comprises an applicator unit 1 with a first backing roll 3 and a doctor unit 2 with a second backing roll 4. While in the configuration of FIG. 1 the applicator apparatus 5 of the applicator unit 1 is the jet-nozzle applicator shown in FIG. 2 equipped with a metering blade, this kind of applicator may be replaced by the apparatuses shown in FIGS. 3 and 4. The web 6 to be coated is taken to a guide roll 7 to the first backing roll 3, on which the web 6 is passed over the surface of the roll 3, whereby the coat can be applied to the web by means of the applicator apparatus 5 adapted under the roll 3. From the first backing roll 3 and the applicator unit 5 the web 6 is taken to the second backing roll 4 on which the web 6 is passed over the surface of the backing roll 4 to travel upward. Close to the second backing roll 4 is arranged a doctor unit 8 which is adapted to operate against that quadrant of the roll which remains between the lowermost point of the roll 4 and the farthest tangential exit point of the web 6 on the roll. This position of the doctor unit 8 is necessary in order to permit the collection of excess coat stripped off the web 6 by the doctor blade 9 into a coat collecting tray 10 located beneath the doctor blade 9. The loading and angle of the doctor blade 9 are adjusted by means of a loading device 11 arranged to press the blade 9 and by rotating the blade support beam 14 with the help of a pivotal lever 13 and a cylinder 12 about the pivot point 15 of the beam. Since the function of such doctor blade devices is well known in the art, a detailed discussion of their structure will be omitted herein. The distance between the applicator unit 1 and the doctor unit 2 is advantageously made adjustable in order to facilitate the control of the dwell time according to the web speed and other coating process conditions.

Figure 2:
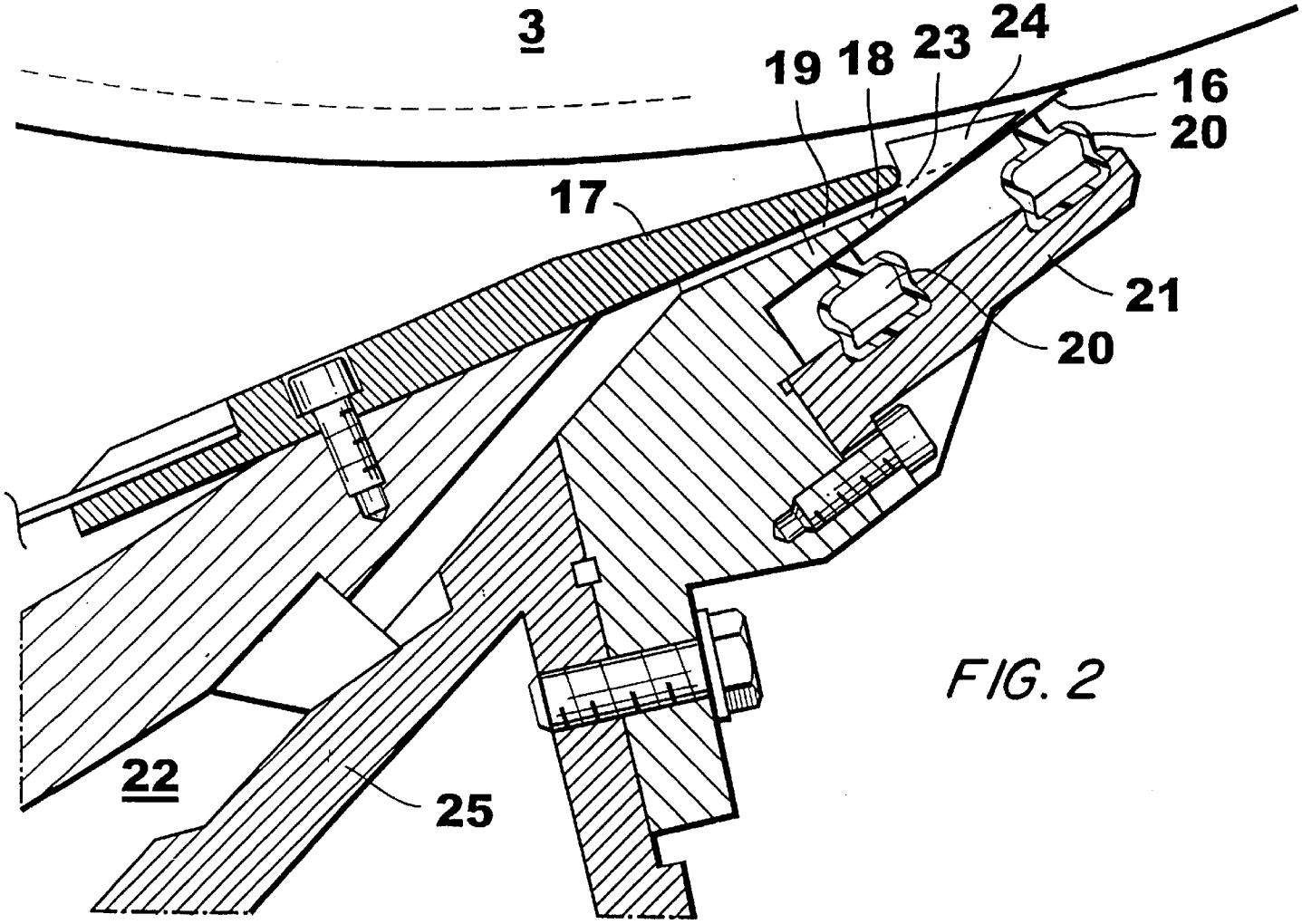
FIG. 2 shows an applicator apparatus equipped with a metering blade.

FIG. 2 shows a jet-nozzle applicator equipped with a metering blade 16. Such an applicator comprises a lower lip 17 and an upper lip 18 forming a narrow slit orifice 23 extending over the entire width of the web being coated. The length of the slit orifice 23 in the cross-machine direction of the web is limited by end seals 24 adapted at the ends of the slit orifice. The coating mix is passed into the slit orifice 23 via a feed channel 19 formed in the support beam 25, and via an application chamber 22. In jet-nozzle applicators having a metering blade 16, the slit orifice 23 commonly has a fixed gap without any adjustment facility for its opening or profile. Thence, the coat thickness is controlled by altering the loading of the blade 16 and/or the pumping rate of the coating mix. The doctor blade 16 is a flexible steel strip whose one edge is supported by being fixed to the upper lip 18 via a blade holder 21 and flexible loading tubes 20 so as to form an extension of the upper lip. One of the loading tubes 20 compresses the blade 16 against the upper lip 18 and the other against the backing roll 3. By increasing the loading of the doctor blade 16, it is possible to reduce the amount of coating mix flowing through the slit orifice 23 to the web, whereby a larger amount of the coating mix can flow reverse to the incoming direction of the web over the lower lip 17. Besides serving the adjustment of applied amount of coat, another important function of the metering blade is to level the coat, whereby the flat coat pigment particles align themselves parallel with the surface of the base sheet. Thus, the benefits of the method according to the invention will become particularly emphasized by using an applicator equipped with a metering blade, because the pigment aligning effect of the metering blade accentuates the advantageous benefits of coat setting allowed by the long dwell time.

Figure 3:
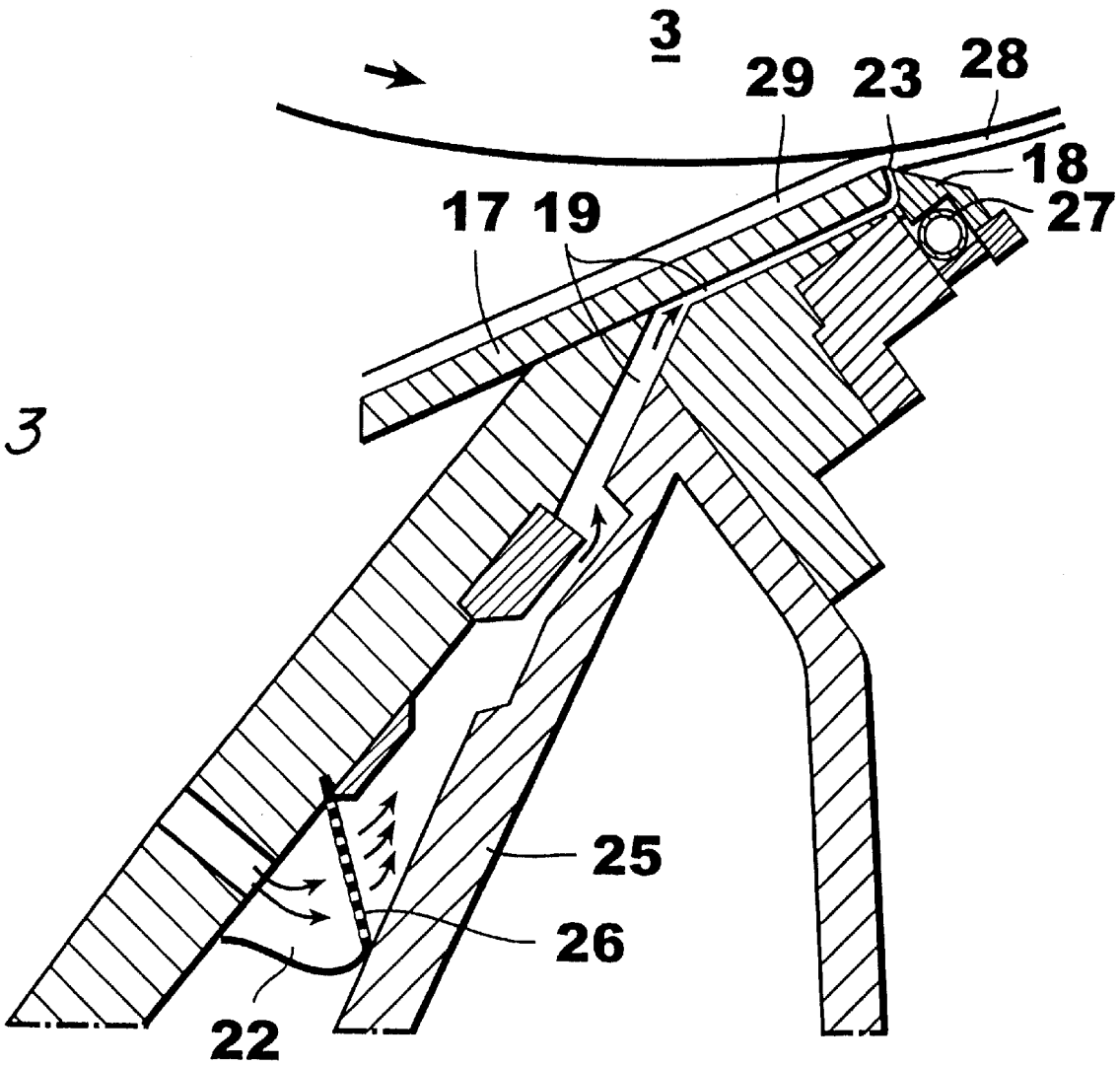
FIG. 3 shows a jet-nozzle applicator apparatus equipped with a return flow arrangement.

In FIG. 3 is shown a jet-nozzle applicator with a return flow arrangement. The applicator includes formed into the support beam 25 an applicator chamber 22 and a jet-nozzle infeed channel 19 which exits into the slit orifice 23. The applicator chamber 22 is provided with a strainer 26 serving to prevent the access of any impurity clumps contained in the coating mix from reaching the slit orifice 23. In jet-nozzle applicators based on applying the coat to the web by means of a freely exiting, unguided jet, the purity and homogeneity of the coating mix must be controlled with particular care, because the gap of the slit orifice 23 is extremely narrow and any impurities will easily plug the orifice. The control of applied amount of coat is implemented in jet-nozzle applicators based on an unguided jet by adjusting the gap of the slit orifice 23 by altering the position and attitude of the upper lip 18. Changing the gap of the slit orifice 23 alters the applied amount of coat and position adjustment of the curved upper lip controls the amount of coat extruded past the lower lip 17 reverse to the travel direction of the web. The coating mix flow 29 passing over the lower lip is called the return flow and the flow 28 adhering to the web forms the applied coat. In the applicator, the coating mix flow is directed slightly reverse to the web travel in order to arrange the coating mix return flow.

Figure 4:
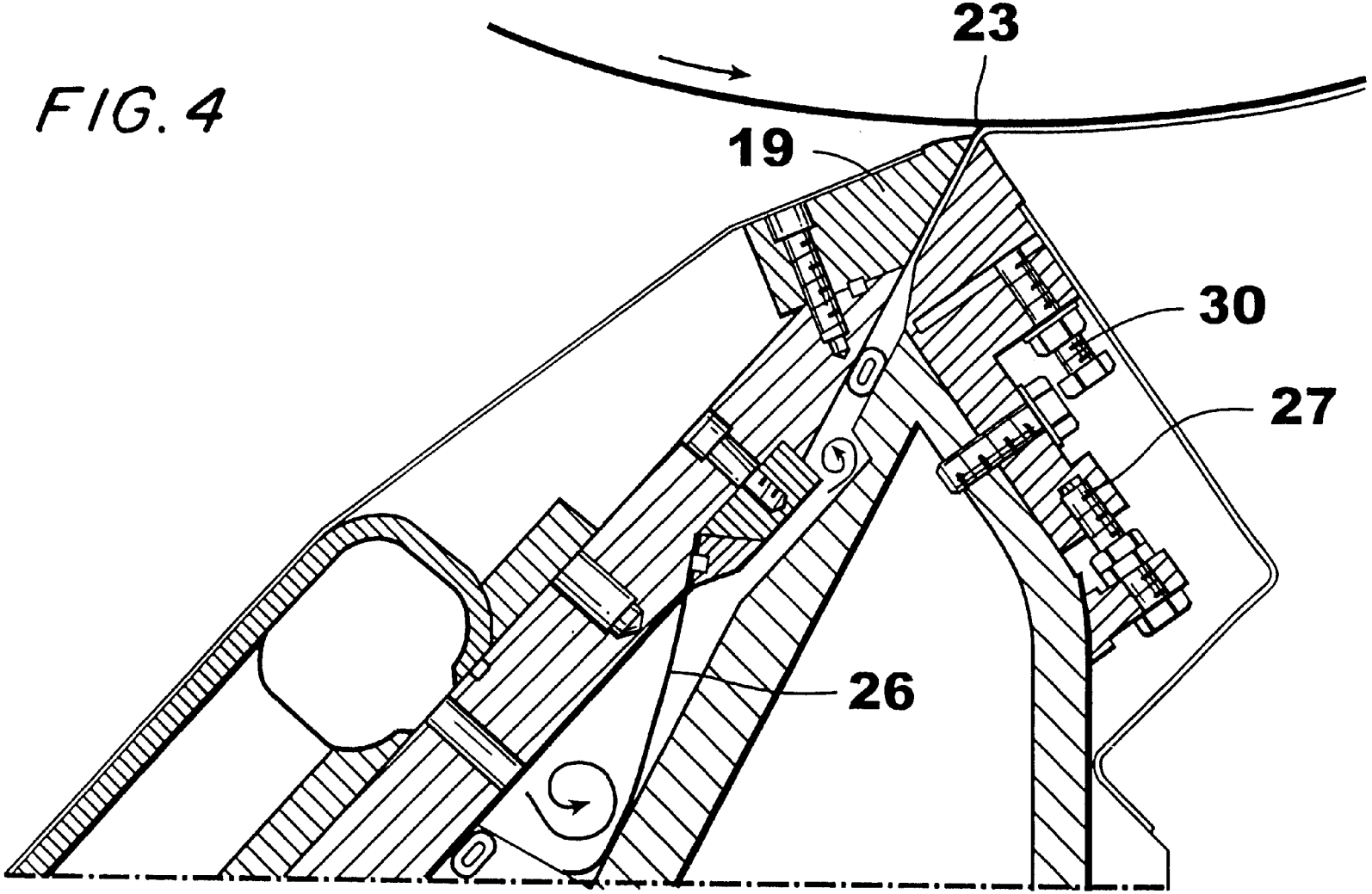
FIG. 4 shows a jet-nozzle applicator apparatus without return flow.

In the jet-nozzle applicator shown in FIG. 4, the slit orifice 23 is directed downstream with the travel of the web and the gap adjustability of the slit orifice is improved by means of a fine-adjustment device 30. The actual control of the gap occurs by means of a coarse-adjustment device 27, while the fine-adjustment device 30 serves for accurate control of applied amount of coat and setting of the coat profile to correct values over the entire cross-machine width of the web. Here, the slit orifice 23 is essentially narrower than in the alternative embodiments described above. Thus, the amount of applied coat can be kept so small that no coating mix return flow is needed, because the applied coat is optimally close to the target end value of coat weight. The jet-nozzle infeed channel 19 is also essentially longer and narrower than in the above-described embodiments, thus causing alignment of the coat particles.

The present invention is based on a long dwell time and use of a coating mix having a high coat solids content. The invention performs best when nozzle or blade application is used, but in some cases benefits may be present even if the coating layer is spread with an applicator roll. Already inherently, a high solids content contributes to higher density of the applied coat, and the long dwell time used causes moisture absorption into the base sheet and settlement of the coating layer on the web, whereby a set layer is formed on the base sheet surface that behaves differently from the layer of higher moisture content which forms the top layer in the applied coat. In the layer on the surface of the base board web, the coat particles can align themselves parallel to the base sheet, whereby their combined area effectively covers the underlying surface of the base sheet and the reflective surface of the coat particles is aligned outward from the web surface.

According to the invention, a coating mix is used in which the solids content is at least 55% of the overall coat weight and the dwell time between the coat metering and doctoring steps is at least 130 ms when the speed of the web being coated is in the range 300–800 m/min. In coaters running at lower web speeds, the dwell time can be made shorter; however, coaters operating at web speeds below 300 m/min are rare in practice. For example, in coaters running at a web speed of 200 m/min, a dwell time as short as 72 ms can be used. As the web speed ranges referred to herein are mentioned principally for the definition of the dwell time, they must not be considered limiting to the permissible operating range of the present method, because modern coaters can be run even at higher web speeds.

Figure 7A:
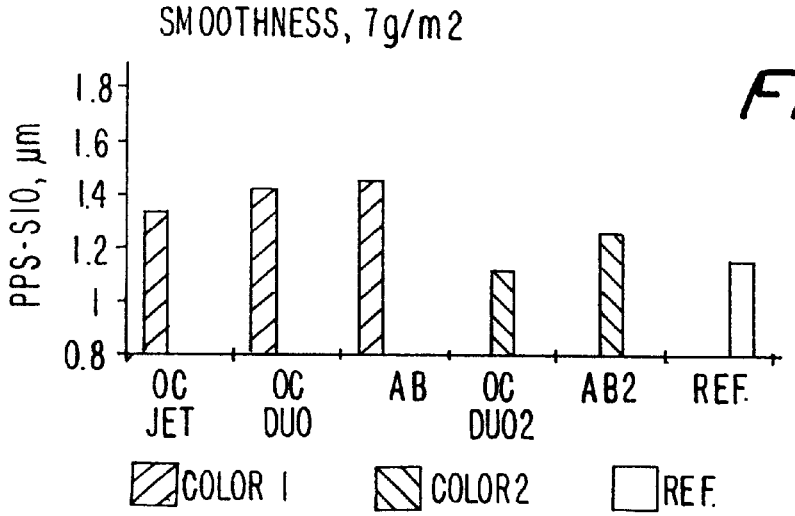
FIGS. 7*a*, 7*b*, 7*c*, 8*a*, 8*b*, 8*c*, 9*a*, 9*b*, 9*c*, 10*a*, 10*b* and 10*c* are tables showing results of trial runs.
Figure 7B:
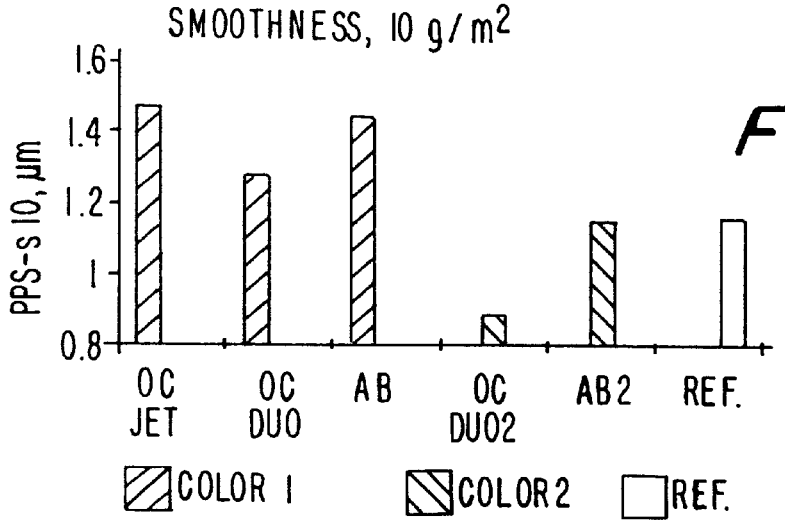
Figure 7C:
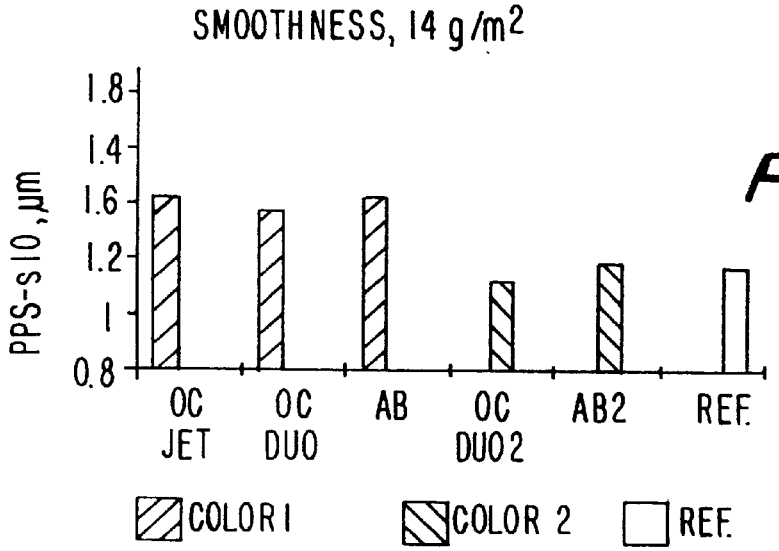
Figure 8A:
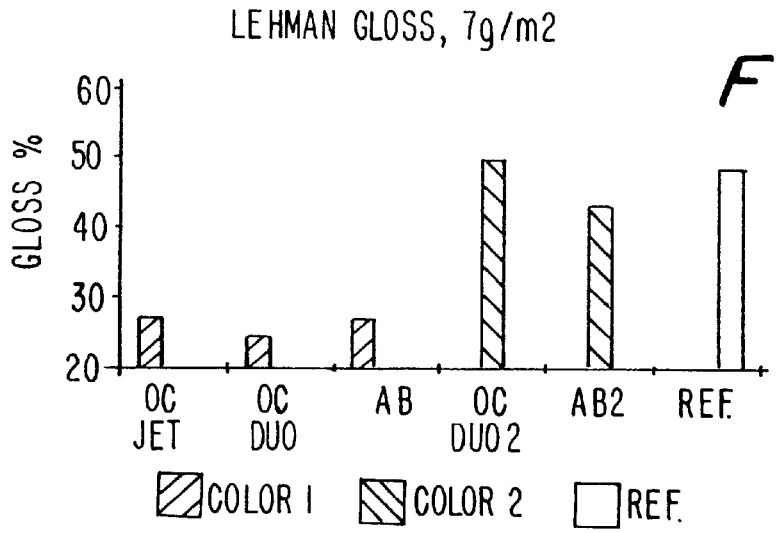
Figure 8B:
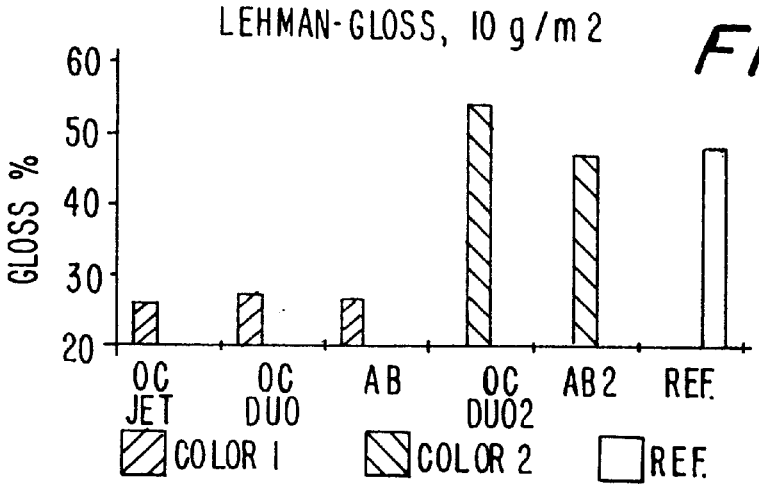
Figure 8C:
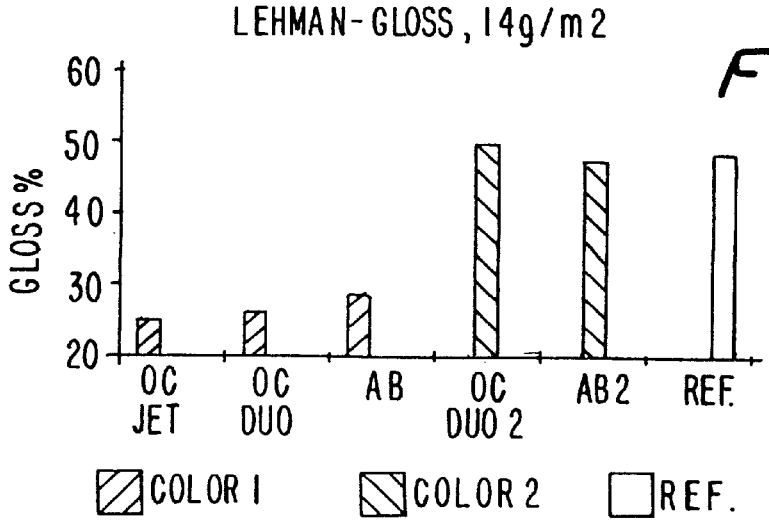

FIGS. 7 and 8 show test results in which paperboard coated by means of the method according to the invention is compared with a reference paperboard coated in a standard mill process. The reference paperboard (Ref) was coated in a spreading roll coater in two steps, whereby the precoat weight was 10 g/m$^2$ and the topcoat weight was 10 g/m$^2$, whereby the overall coat weight was 20 g/m$^2$. The coating mix had a solids content of 69%. The pigment of the coating mix was 100% calcium carbonate. This formulation of the coating mix corresponds to coating mix no. 2 (color 2) used in the test plant.

The test was performed using a paperboard similar to the reference paperboard, however, without the topcoat. Then, a 7, 10 and 14 g/m$^2$ topcoat was applied at the test plant onto the 10 g/m$^2$ precoat, which had been applied earlier under the standard conditions of the mill process. When the base stock was coated with coating mix no. 2 at the test plant using a similar coater as that of the mill, the test sample AB2 achieved the same degree of smoothness as the reference sample coated in the mill process. The AB coater was a spreading roll applicator in which the coat was smoothed by a doctor blade. When coating mix no. 2 was applied in an Opticoat Duo coater (OC Duo2) illustrated in FIG. 1, a much improved smoothness over the reference paperboard was obtained. The dwell distance in the Opticoat Duo coater was 1600 mm.

In the second reference test using coating mix no. 1 (color 1), the formulation consisted of a mixture of calcium carbonate and kaolin. In the coating formulation, 30% of calcium carbonate was mixed with 70% of kaolin. The solids content of the coating mix was 63%. This test, which was run using an Opticoat Jet applicator of the type illustrated in FIG. 4 set for 400 mm dwell distance, gave a smoothness essentially equal to that provided by a spreading roll (AB). Test runs were also run using an Opticoat Duo apparatus having an applicator unit with a premetering blade and a doctor blade operating on a separate backing roll. Better smoothness was achieved with the Opticoat Duo with all coat weights than with the roll applicator unit and also in most cases the Opticoat Duo achieved better smoothness than the Opticoat Jet. The Opticoat Jet was best in lightest coat weight which probably was a result of the relatively short dwell time of the apparatus operating on a single backing roll. From FIGS. 8*a*–8*c* can be seen, that also better gloss was achieved with the long dwell time and using an applicator having a predoctoring blade (OCDUO2) than with a roll applicator coater (AB, ref). The benefits of a long dwell time were clearly demonstrated using the Opticoat Duo application adjusted to 1600 mm dwell distance. Here, a degree of smoothness undeniably superior to that provided by other coaters was obtained.

Figure 9A:
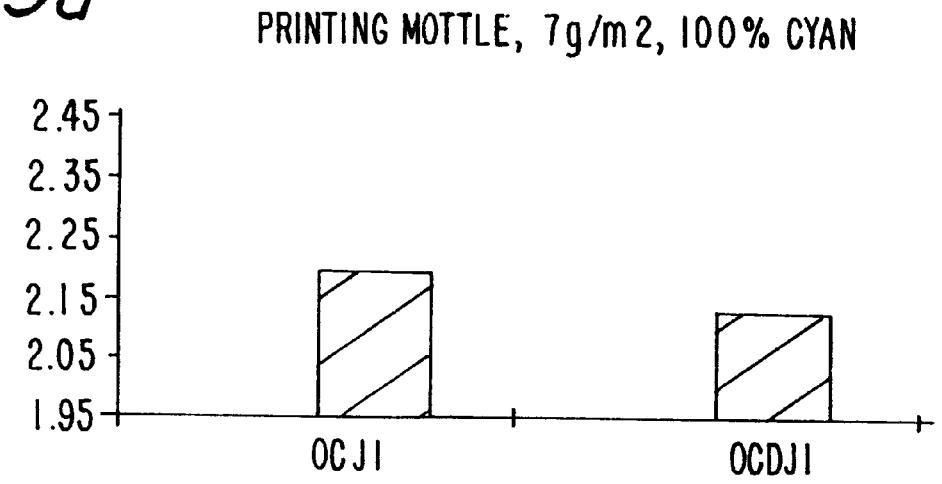
Figure 9B:
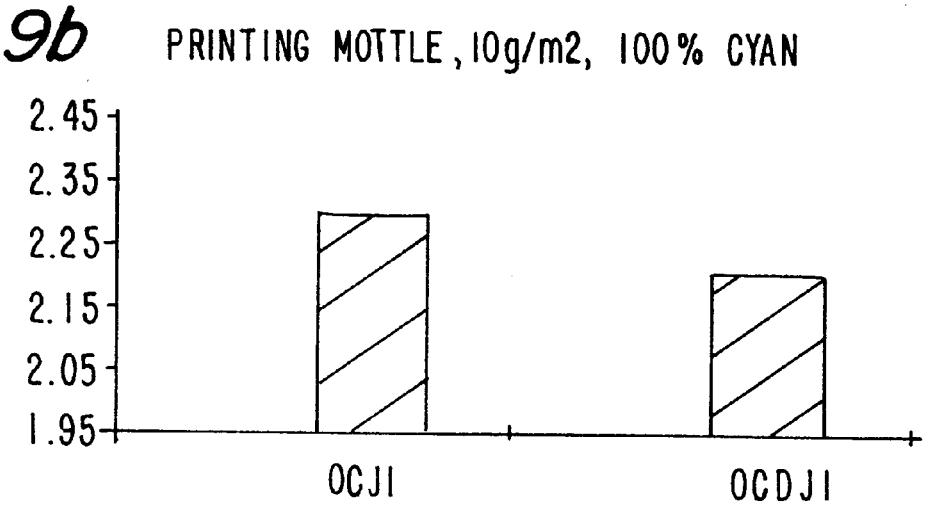
Figure 9C:
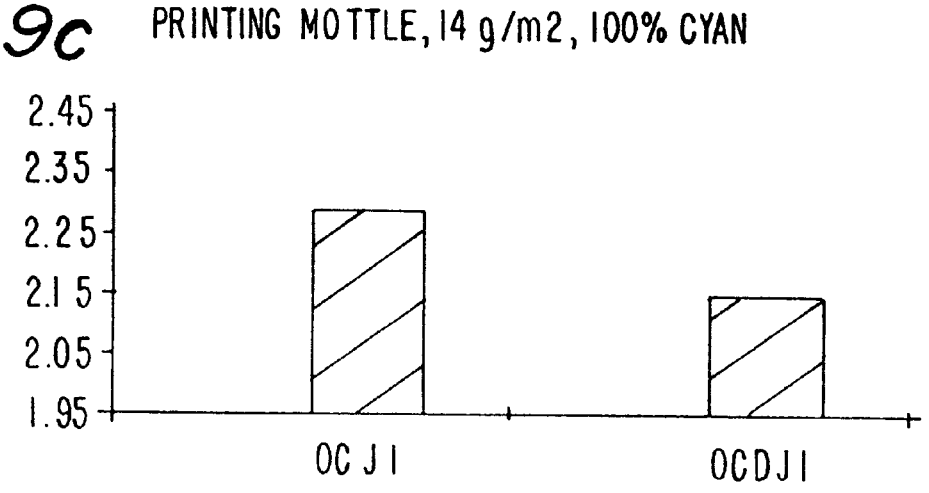
Figure 10A:
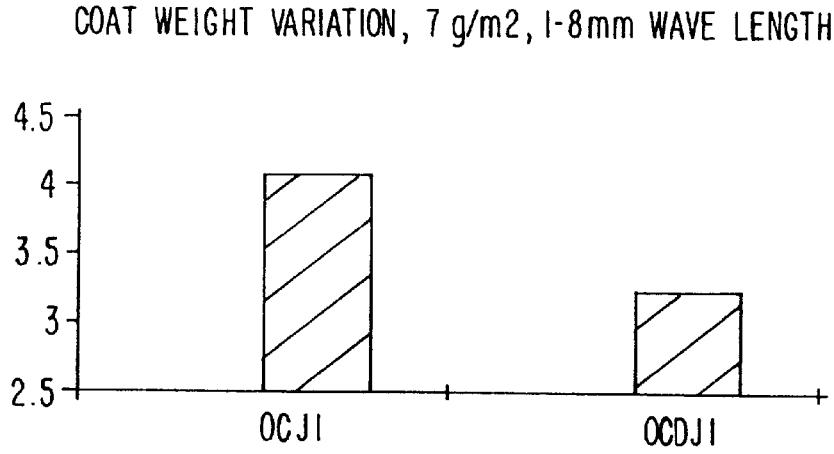
Figure 10B:
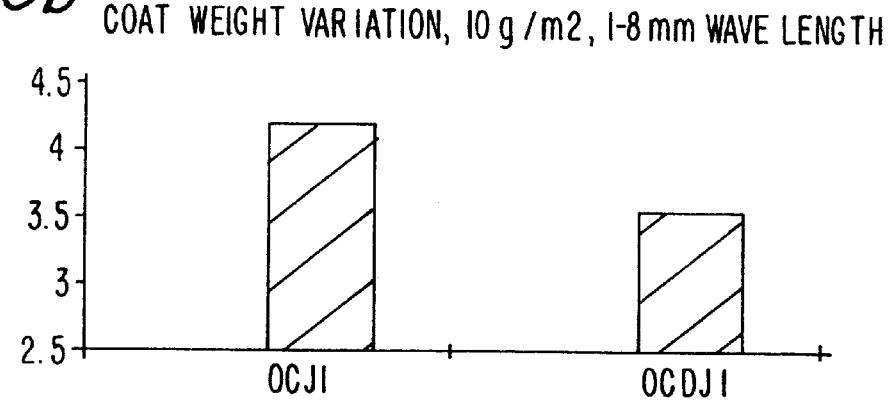
Figure 10C:
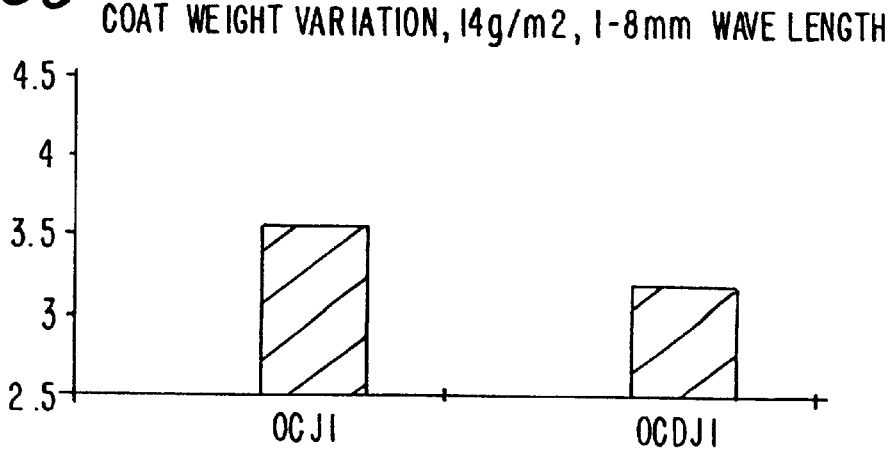

In addition to the above test runs a test run corresponding the above mentioned was made using color 2, wherein the effects of the variation of the dwell time on the results were compared using the nozzle applicator shown in FIG. 4. Single and twin backing roll configurations were used. In FIGS. 9 and 10 results of the single backing roll unit are marked with OCJ1 and the twin roll unit with OCDJ1. In this comparison no significant differences in the smoothness and gloss of the end product were revealed, but in the FIGS. 9 and 10 are shown the properties wherein the dwell time had effect. In FIGS. 9*a*–9*c* it is shown that increased dwell time had clearly an effect on the evenness of the coating layer, since on the long dwell time (OJDC1) the variation of the coat weight was smaller than on the shorter dwell time (OCJ1). This shows that on the longer dwell time the coating mix had settled better as an even layer on the web. The same deduction can be made on the bases of the results shown in FIGS. 10*a*–10*c*. On the bases of these results it can be noted that the settlement of the printing color becomes better when the coating color is settled evenly on the base board on the long dwell time. If the coating color settles unevenly and the base board is shown partially under the coat on the printing surface, the difference of the porousness of the coating and the base board causes uneven settlement and penetration of the printing color.

In the above described comparisons a better smoothness or more even thickness of the coating layer was achieved by using a nozzle applicator or applicator having a predoctor blade, long dwell time and blade doctoring than when a roll applicator was used. It is difficult to enhance both of the above mentioned properties simultaneously, but both factors can be effected by using the method according to the invention. More coating mix remains on the surface of the base web when this method is used than when a roll application method is used. It depends on the filtration properties of the coating mix, absoption capabilities of the base board web, changes in the roughness caused by water penetration and the compressibility of the web whether the surface of the end product is smooth or if the thickness of the coating layer is even. In this sense the evenness of the coating layer in the cross- and on-machine directions is not considered but rather the evenness of the thickness of the coating layer over the surface structure of the base board.

In FIG. 11 is described trial runs wherein the base web was coated with three or two coating layers and the second layer was made with the Opticoat Duo apparatus. Comparative coating was made with a roll applicator apparatus. The figure shows changed and improved properties of smoothness and gloss and variation of the coating color thickness depending of the case.

Finally it can be stated that the invention provides excellent possibilities for effecting different factors of the coating quality.

Thus, while there have been shown and described and pointed out fundamental novel features of the present invention as applied to preferred embodiments thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A method of producing paperboard, comprising steps of:

applying with an applicator apparatus a coating mix layer having a thickness greater than that of a final coat thickness to a surface of a paperboard web being coated using a coating mix formulation in which the solids content is at least 55%;

passing the web with the coating mix layer applied thereto to a doctor blade located downstream in the travel direction of the web at a distance from the applicator apparatus such that the dwell time from the application step of the coating mix to the doctoring step is at least 130 ms and so that moisture is absorbed by the web from the coating mix; and smoothing the coating mix layer to its final coat thickness by means of the doctor blade.

2. The method of claim 1, wherein the coating mix is applied using a jet-nozzle applicator comprising a pre-metering blade.

3. The method of claim 1, wherein the coating mix is applied using a jet-nozzle applicator in which a coating mix jet thereof is aligned at least partially reverse to the travel direction of the web in order to provide a return flow.

4. The method of claim 1, wherein the coating mix is applied using a jet-nozzle applicator in which a coating mix jet thereof is aligned downstream with the travel direction of the web and the amount of coating mix applied is controlled to a level at which the entire amount of applied coating mix becomes adhered to the web.

5. The method of claim 1, wherein the coating mix is applied to the web passing over a first backing roll and the doctoring step is performed against a second backing roll over which the web is subsequently passed.

6. The method of claim 1, wherein the dwell time between the application step and the doctoring step is selected on the basis of at least one of the web speed, a desired coat quality and a factor affecting the coating process.

7. The method of claim 1, wherein the solids content of the coating mix is 55–70% and the web speed is 300–800 m/min.

8. An apparatus for producing paperboard, comprising:

an applicator apparatus for spreading coating mix having a solids content of atleast 55% onto a surface of a paperboard web to be coated;

a doctor blade for smoothing and levelling the spread coating mix to a final coat thickness, the doctor blade being located downstream in a travel direction of the web at a distance from the applicator apparatus such that a dwell time from applying of the coating mix to doctoring is at least 130 ms at a web speed of 300–800 m/min. and so that moisture is absorbed by the web from the coating mix; and at least one backing roll for supporting the web during spreading of the coating mix and during doctoring.

9. The apparatus of claim 8, wherein the applicator apparatus is a jet-nozzle applicator comprising a pre-metering blade.

10. The apparatus of claim 8, wherein the applicator apparatus is a jet-nozzle applicator comprising a coating mix jet aligned at least partially reverse to the travel direction of the web in order to provide a return flow.

11. The apparatus of claim 8, wherein the applicator apparatus is a jet-nozzle applicator comprising a coating mix jet aligned downstream in the travel direction of the web and the amount of the applied coating mix is controlled to a level at which the entire amount of coating mix applied becomes adhered to the web.

12. The apparatus of claim 8, further comprising two backing rolls positioned so that the coating mix is applied to the web passing over a first of the backing rolls and doctoring is performed against a second of the backing rolls over which the web is subsequently passed.

* * * * *